US006733081B1

(12) United States Patent
Follon et al.

(10) Patent No.: US 6,733,081 B1
(45) Date of Patent: May 11, 2004

(54) RETRACTABLE FOOTREST FOR A HAIRSTYLING CHAIR

(75) Inventors: Marva Nadine Follon, Des Moines, IA (US); Clarence H. Rail, Ankeny, IA (US)

(73) Assignee: Marva Follon, Des Moines, IA (US)

( * ) Notice: Subject to any disclaimer, the term of this patent is extended or adjusted under 35 U.S.C. 154(b) by 165 days.

(21) Appl. No.: 09/715,624

(22) Filed: Nov. 17, 2000

(51) Int. Cl.[7] ..... A47C 20/00
(52) U.S. Cl. ..... 297/423.26
(58) Field of Search ..... 297/423.26, 183.1, 297/423.19, 423.3, 423.28

(56) References Cited

U.S. PATENT DOCUMENTS 484,747 A * 10/1892 Stuck
488,707 A * 12/1892 Cloutier
4,515,407 A * 5/1985 Crum
4,775,184 A * 10/1988 Larkin
5,259,664 A * 11/1993 Cottle
6,196,631 B1 * 3/2001 Larson

* cited by examiner

*Primary Examiner*—Milton Nelson, Jr.
(74) *Attorney, Agent, or Firm*—Daniel A. Rosenberg; Kent A. Herink; Davis Brown Law Firm

(57) ABSTRACT

A chair is provided with a seat and a base for securing the chair to the floor. A footrest secures to the seat, and a linking mechanism moves the footrest between an extended and a retracted position. The linking mechanism comprises a bracket that allows the footrest to pivotably mount thereto. A handle pivotably secures to the bracket and a first end of a first link. The second end of the first link pivotably secures to the first end of a second link, and the second end of the second link pivotably secures to an additional pivotable mount on the footrest. Movement of the handle moves the footrest between the extended and retracted positions.

2 Claims, 5 Drawing Sheets

RETRACTABLE FOOTREST FOR A HAIRSTYLING CHAIR

BACKGROUND OF THE INVENTION

The present invention relates to a retractable footrest for a hairstyling chair. In particular, a retractable footrest that uses a linking mechanism to move between an extended and a retracted position.

Standard U-shaped footrests, of the type commonly attached to hairstyling chairs, are well known and in wide spread use. While the footrest is convenient and easy to use when a person is seated in a hairstyling chair, the footrest can make getting in and out of the chair difficult. Because the footrest typically is fixed in an extended position, it creates a barrier that prevents a person from getting close enough, to comfortably and safely enter and exit a traditional hairstyling chair.

Accordingly, a need exists for a hairstyling chair that includes a footrest that allows a person to more easily enter and exit the chair.

SUMMARY OF THE INVENTION

An object of the present invention comprises providing a retractable footrest for a chair.

These and other objects of the present invention will become apparent to those skilled in the art upon reference to the following specification, drawings, and claims.

The present invention intends to overcome the difficulties encountered heretofore. To that end, a chair is provided with a seat and a base for securing the chair to the floor. A footrest secures to the seat, and a linking mechanism moves the footrest between an extended and a retracted position.

DETAILED DESCRIPTION OF THE INVENTION

Figure 1A:
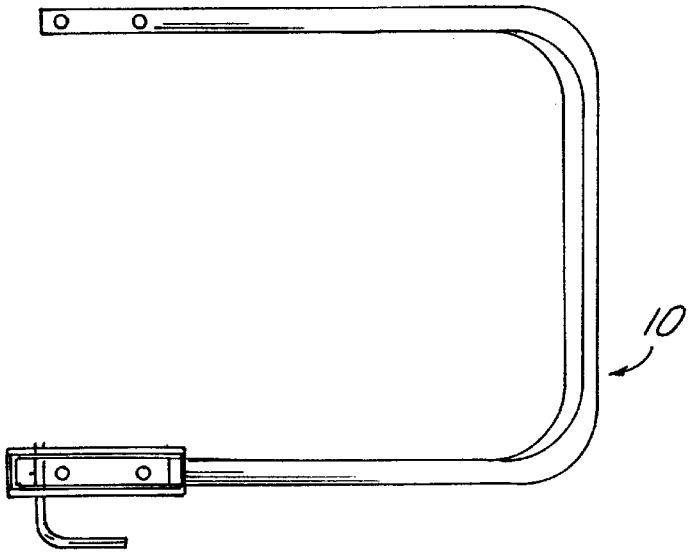
FIG. 1*a* is a top view of a footrest mechanism.
Figure 2A:
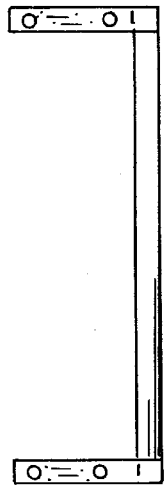
FIG. 2*a* is a side view of a mounting bracket for mounting the footrest mechanism to a chair.
Figure 1B:
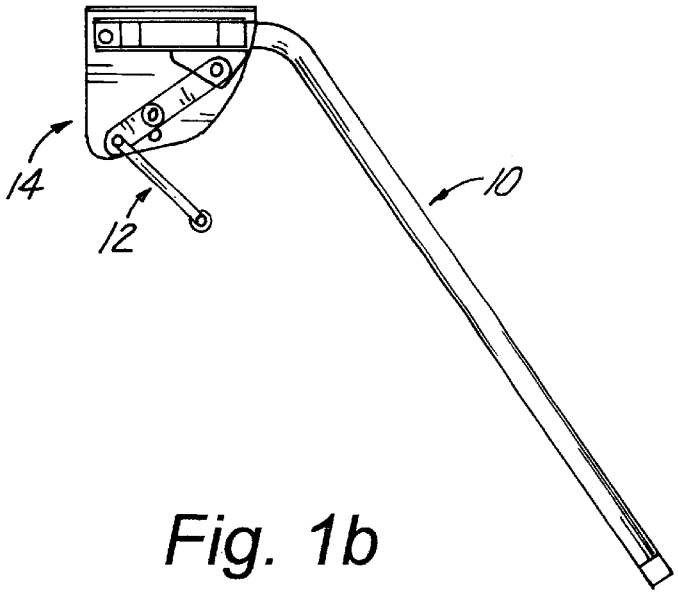
FIG. 1*b* is a side view of the footrest mechanism in the extended position.
Figure 2B:
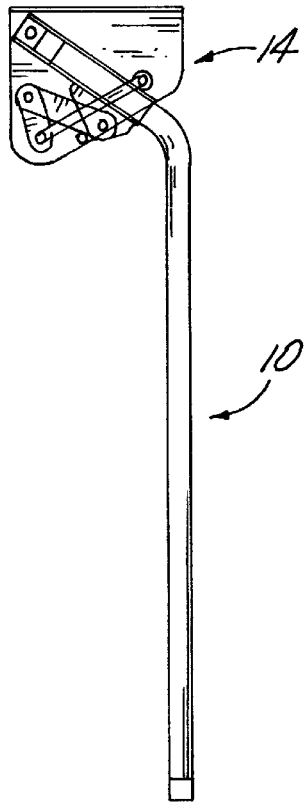
FIG. 2*b* is a side view of the footrest mechanism in the retracted position.

In the Figures, FIGS. 1*a* and 1*b* show a footrest 10 from a top view and a side view. The Figures also show a linking mechanism 14 that includes a handle 12, and various other components, which will be disclosed in detail herein. FIG. 1*a* and 1*b* show the linking mechanism 14 in a position such that the footrest 10 is extended. FIGS. 2*a* and 2*b* show the linking mechanism in a position with the footrest 10 retracted. In the retracted position, the footrest 10 is conveniently tucked below the seat portion of the chair (not shown). This allows a person to enter and exit the chair unhindered by the presence of the footrest. Once seated in the chair the handle 12 can be manipulated to extend the footrest to the positions shown in the FIGS. 1*a* and 1*b*.

Figure 3A:
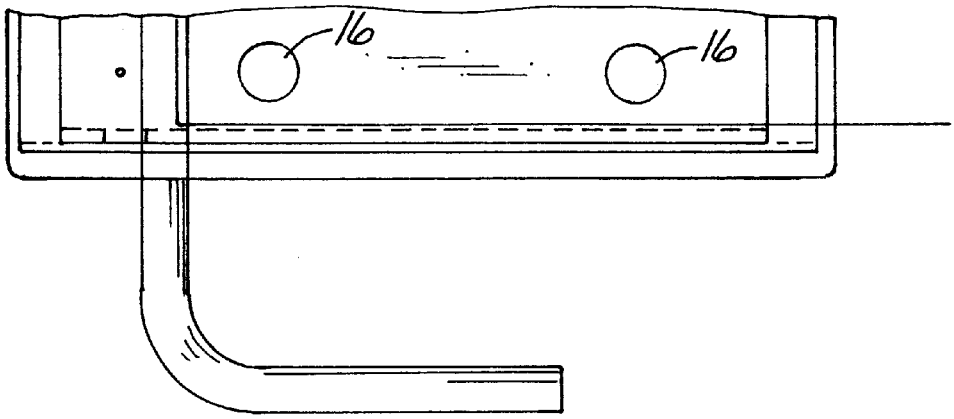
FIG. 3*a* is a top view of a footrest bracket.
Figure 3B:
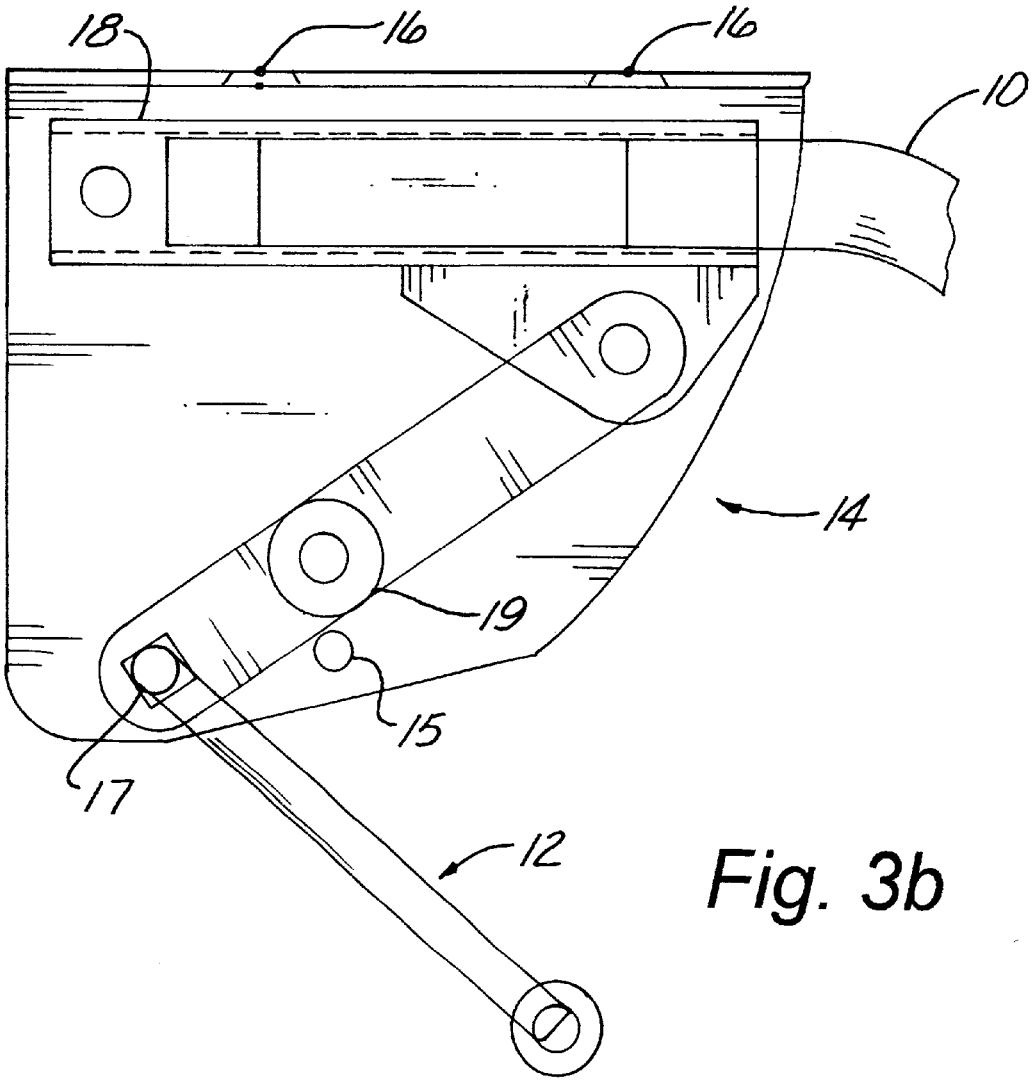
FIG. 3*b* is a side view of the footrest bracket and linking mechanism in the extended position.
Figure 8:
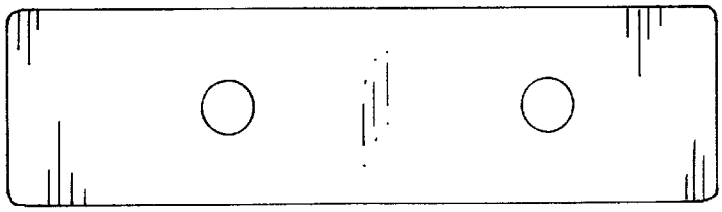
FIG. 8 is a top view of a mounting piece for securing the bracket.
Figure 9:
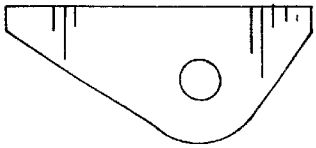
FIG. 9 is a side view of an ear for pivotably connecting the footrest and the second link.
Figure 10A:
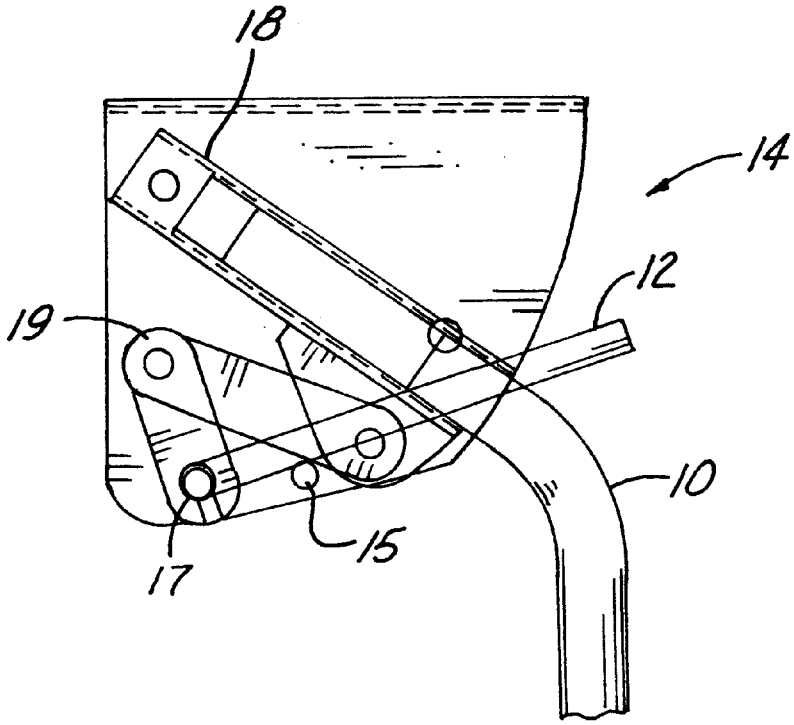
FIG. 10*a* is side view of the footrest mechanism in the retracted position.
Figure 10B:
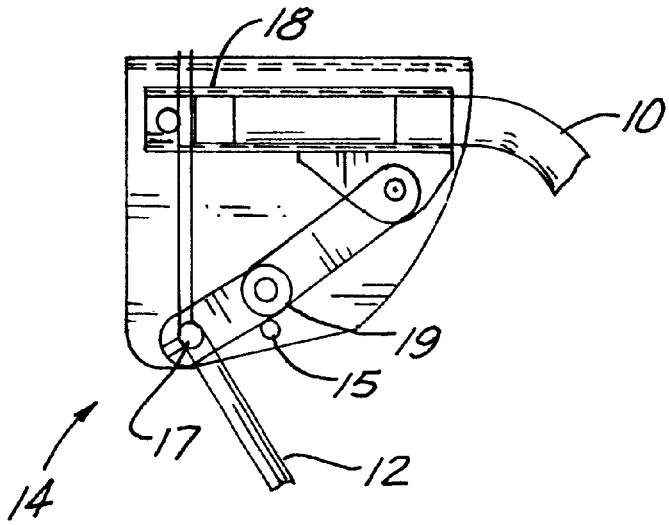
FIG. 10*b* is side view of the footrest mechanism in the extended position.

In detail, FIGS. 3*a* and 3*b* show that the linking mechanism 14 is secured to the underside of the chair with the mounting bracket marked Detail 1 shown in FIG. 3*a*, and FIG. 3*b*, and in greater detail in FIG. 8. In order to fit the bracket to the bottom of a chair, a wedge or similar device may be needed to conform to the surface of the bottom of the chair. FIG. 3*a* shows a portion of the invention from the top view, which shows that Detail 1 includes two boltholes 16 used to attach the linking mechanism 14 to the footrest 10, and the chair. Detail 1 secures directly to Bracket 1, which is shown in particular detail in FIG. 3*b*. Bracket 1 contains a plurality of holes 16 designed to allow attachment of the components of the linking mechanism 14, which allows the footrest 10 to pivot between the retracted position and the extended position.

In particular, the footrest 10 secures to Bracket 1 through a collar 18 which attaches through the bolthole 16 located in the upper left hand portion of Bracket 1. The footrest 10 inserts into the collar 18. Affixed to the collar 18 is Detail 3. Detail 3 forms an ear or anchor that includes a bolthole that allows for securement of Link 2. Further, Link 1 is secured to Bracket 1 at the bolthole 16 located in the lower left hand portion of Bracket 1. At this point, the handle 12 secures to Link 1, and Link 1 secures to Bracket 1. Link 1 secures to Bracket 1 through an upwardly extending pin 17 that includes a flattened end to allow Link 1 to properly fit over the pin 17 and to be held in place. A handle 12 for triggering the mechanism 14 is secured to the pin 17 with a set screw (not shown). Link 1 and Link 2 are secured at the pivot point 19 shown best in FIG. 3*b*, and can pivot relative to each other about that point 19. A pin 15 serves as a stop for extension of the footrest 10.

FIG. 3*b* shows the linking mechanism 14 in a position that extends the footrest 10. In this position handle 12 is downwardly located, and Link 1 and Link 2 are fully extended pushing Detail 3, collar 18, and the footrest 10 captured therein, into the extended position.

Figure 4:
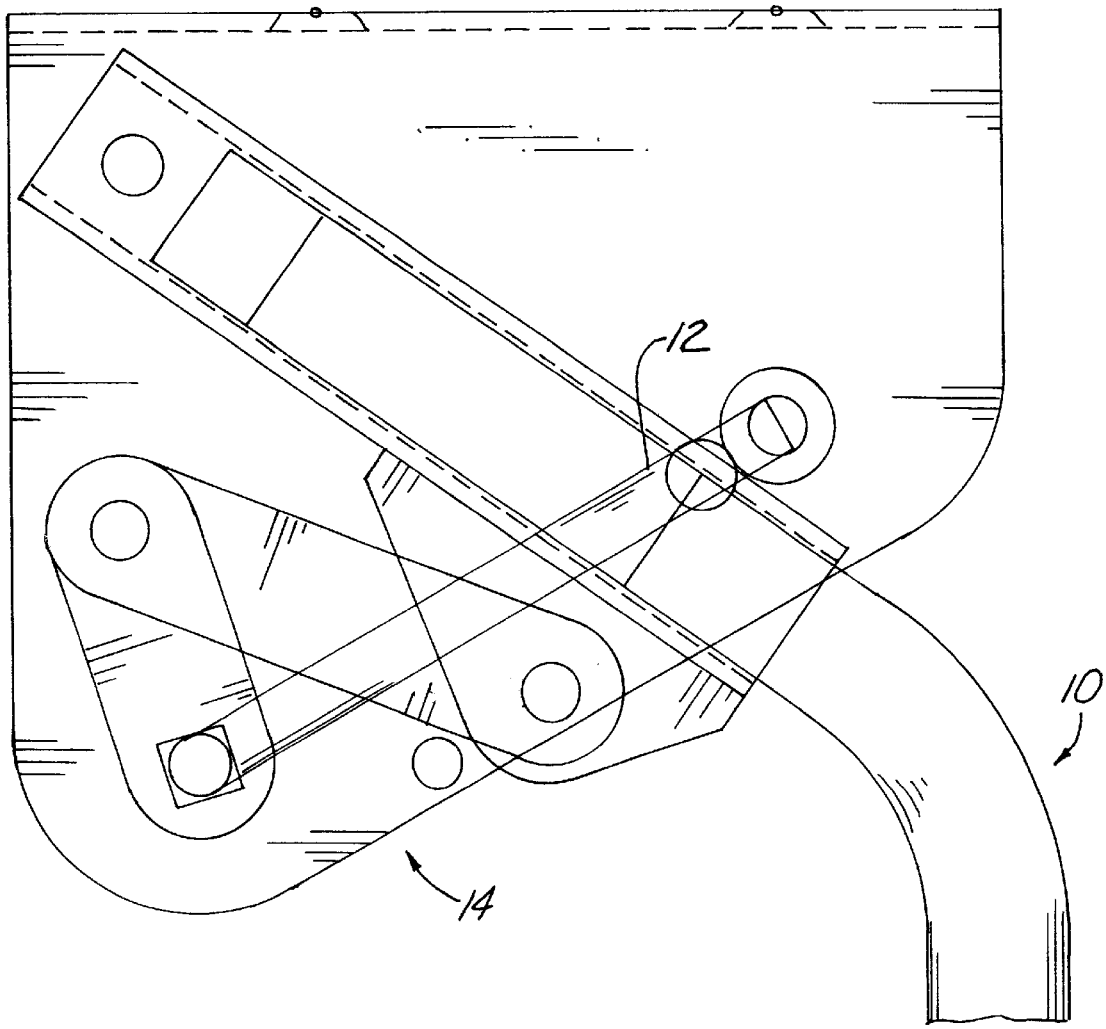
FIG. 4 is a side view of the footrest bracket and linking mechanism in the retracted position.
Figure 5:
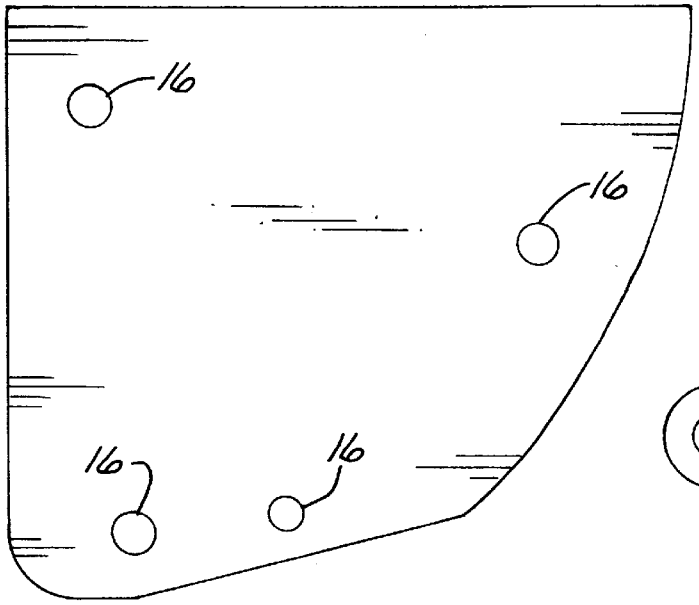
FIG. 5 is a side view of the bracket.
Figure 6:
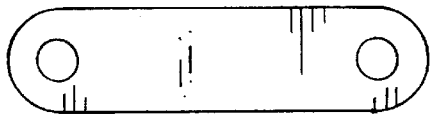
FIG. 6 is a side view of a first link.
Figure 7:
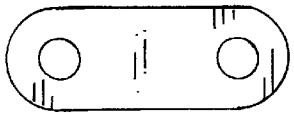
FIG. 7 is a side view of a second link.

FIG. 4 shows the linking mechanism 14 in the retracted position. In order to move between the extended position and the retracted position, handle 12 is moved upward in an arc. This causes Link 1 and Link 2 to pivot about point 1 which forces Detail 3 and the attached collar 18 with the footrest captured therein, to move downward. This places the footrest 10 in a position below the seat of the chair, and out of the way of the user. As can be seen from the Figures, the collar 18 is secured to Bracket 1 at bolthole 16, located in the upper left hand portion of Bracket 1, in such a manner that the collar 18 can pivot relative to Bracket 1. Additionally, Link 1 is secured to the bolt hole 16, located in the lower left hand portion of Bracket 1, in such a manner to allow Link 1 to pivot relative to Bracket 1 upon movement of handle 12.

The mechanism 14 ensures that the footrest 10 remains in the extended position by positioning the stop pin 15 at a point such that the pivot point 19 between Link 1 and Link 2 extends past center. Thus, downward pressure on the extended footrest 10 will force Link 1 and Link 2 into pin 15. The footrest 10 can be further supported in the extended and retracted positions through the use of a compression spring, such that if the footrest is not fully extended or retracted the spring will bias the footrest 10 into one or the other of the two positions.

The foregoing description and drawings merely explain and illustrate the invention, and the invention is not limited thereto. Those skilled in the art that have the disclosure before them will be able to make modifications and variations therein without departing from the scope of the invention. Merely listing the steps of the method in a certain order does not constitute any limitation on the order of the steps of the method, or how they are contemplated and expected based on the application of ordinary skill.

What is claimed is:

1. A chair and retractable footrest combination, said combination comprising:

a chair with a seat, and a base securing said seat to a floor;

a footrest secured to said seat;

a linking mechanism for moving said footrest between an extended position and a retracted position, said linking mechanism comprising:

a bracket secured to said seat;

a handle;

a first link having a first end pivotably secured to said handle-and said bracket, and a second end;

a second link having a first end pivotably secured to said second end of said first link, and a second end;

wherein said foot rest is pivotably secured to said bracket at one end, and said footrest is pivotably secured to said second end of said second link; and wherein moving said handle causes said footrest to move between said extended position and said retracted position.

2. The invention in accordance with claim 1 wherein said chair comprises a hairstyling chair.

* * * * *